US007135448B2

(12) United States Patent
Lentsch et al.

(10) Patent No.: US 7,135,448 B2
(45) Date of Patent: Nov. 14, 2006

(54) WAREWASHING COMPOSITION FOR USE IN AUTOMATIC DISHWASHING MACHINES, COMPRISING A MIXTURE OF ALUMINUM AND ZINC IONS

(75) Inventors: Steven E. Lentsch, St. Paul, MN (US); Michael J. Bartelme, Eden Prairie, MN (US); Victor F. Man, St. Paul, MN (US); Burton M. Baum, Mendota Heights, MN (US); Terence P. Everson, Eagan, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 10/612,474

(22) Filed: Jul. 2, 2003

(65) Prior Publication Data

US 2005/0003979 A1 Jan. 6, 2005

(51) Int. Cl.
*C11D 3/395* (2006.01)

(52) U.S. Cl. ..... 510/220; 510/224; 510/227; 510/367; 510/379; 510/441; 510/485; 510/508; 510/514; 510/521

(58) Field of Classification Search ..... 510/220, 510/224, 227, 367, 379, 441, 485, 508, 514, 510/521, 233, 509
See application file for complete search history.

(56) References Cited

U.S. PATENT DOCUMENTS

| | | | | |
|---|---|---|---|---|
| 2,447,297 | A | 8/1948 | Wegst et al. | |
| 2,514,304 | A * | 7/1950 | Bacon et al. | 134/29 |
| 2,575,576 | A | 11/1951 | Bacon et al. | |
| 3,048,548 | A | 8/1962 | Martin et al. | |
| 3,128,250 | A | 4/1964 | Lintner | |
| 3,255,117 | A * | 6/1966 | Knapp et al. | 510/227 |
| 3,334,147 | A | 8/1967 | Brunelle et al. | |
| 3,350,318 | A * | 10/1967 | Green | 510/227 |
| 3,442,242 | A | 5/1969 | Laskey et al. | |
| 3,677,820 | A | 7/1972 | Rutkowski | |
| 3,701,736 | A | 10/1972 | Austin et al. | |
| 3,755,180 | A | 8/1973 | Austin | |
| 3,764,559 | A * | 10/1973 | Mizuno et al. | 510/230 |
| 3,966,627 | A | 6/1976 | Gray | |
| 4,102,799 | A | 7/1978 | Finck | |
| 4,390,441 | A * | 6/1983 | Beavan | 134/1 |
| 4,426,362 | A | 1/1984 | Copeland et al. | |
| 4,443,270 | A | 4/1984 | Biard et al. | |
| 4,501,681 | A | 2/1985 | Groult et al. | |
| 4,606,775 | A | 8/1986 | Robinson et al. | |
| 4,618,914 | A | 10/1986 | Sato et al. | |
| 4,687,121 | A | 8/1987 | Copeland | |
| 4,690,305 | A | 9/1987 | Copeland | |
| RE32,763 | E | 10/1988 | Fernholtz et al. | |
| RE32,818 | E | 1/1989 | Fernholz et al. | |
| 4,826,661 | A | 5/1989 | Copeland et al. | |
| 4,830,773 | A | 5/1989 | Olson | |
| 4,908,148 | A | 3/1990 | Caravajal et al. | |
| 4,917,812 | A | 4/1990 | Cilley | |
| 4,933,101 | A | 6/1990 | Cilley et al. | |
| 4,954,280 | A * | 9/1990 | Elliott et al. | 510/222 |
| 5,152,910 | A | 10/1992 | Savio et al. | |
| 5,152,911 | A | 10/1992 | Savio et al. | |
| 5,169,552 | A * | 12/1992 | Wise | 510/223 |
| 5,281,352 | A | 1/1994 | Savio et al. | |
| 5,292,446 | A * | 3/1994 | Painter et al. | 510/230 |
| 5,384,061 | A * | 1/1995 | Wise | 510/223 |
| 5,512,266 | A | 4/1996 | Brown et al. | |
| 5,624,892 | A | 4/1997 | Angevaare et al. | |
| 5,625,842 | A | 4/1997 | Dalrymple | |
| 5,698,506 | A | 12/1997 | Angevaare et al. | |
| 5,700,294 | A | 12/1997 | Boittiaux et al. | |
| 5,721,277 | A | 2/1998 | Tang | |
| 5,731,276 | A | 3/1998 | Argo et al. | |
| 5,731,277 | A | 3/1998 | Gary et al. | |
| 6,150,324 | A | 11/2000 | Lentsch et al. | |
| 6,156,715 | A | 12/2000 | Lentsch et al. | |
| 6,164,296 | A | 12/2000 | Lentsch et al. | |
| 6,177,392 | B1 | 1/2001 | Lentsch et al. | |
| 6,258,765 | B1 | 7/2001 | Wei et al. | |
| 6,369,021 | B1 | 4/2002 | Man et al. | |
| 6,410,495 | B1 | 6/2002 | Lentsch et al. | |
| 6,448,210 | B1 | 9/2002 | Keyes et al. | |
| 6,622,736 | B1 | 9/2003 | Hahn | |
| 2003/0050205 | A1 | 3/2003 | Hahn | |

FOREIGN PATENT DOCUMENTS

| | | |
|---|---|---|
| DE | 25 39 531 A | 3/1977 |
| DE | 25 39 531 A1 | 3/1977 |
| EP | 0 070 587 A1 | 1/1983 |

(Continued)

OTHER PUBLICATIONS

"Chelating Agents," *Kirk-Othmer Encyclopedia of Chemical Technology—Castor Oil to Chlorosulfuric Acid*, Third Edition, vol. 5, pp. 339-367 (© 1979).

(Continued)

*Primary Examiner*—Charles Boyer
(74) *Attorney, Agent, or Firm*—Merchant & Gould P.C.

(57) ABSTRACT

A warewashing detergent composition is provided according to the invention. The warewashing detergent composition includes a cleaning agent, an alkaline source, and a corrosion inhibitor. The cleaning agent comprises a detersive amount of a surfactant. The alkaline source is provided in an amount effective to provide a use solution having a pH of at least about 8. The corrosion inhibitor includes a source of aluminum ion and a source of zinc ion. Methods for using and manufacturing a warewashing detergent composition are provided.

11 Claims, 3 Drawing Sheets

FOREIGN PATENT DOCUMENTS

| | | | | |
|---|---|---|---|---|
| EP | 0 387 997 | A2 | | 7/1990 |
| EP | 0 962 521 | A | | 12/1999 |
| GB | 1 442 885 | | | 7/1976 |
| GB | 1 442 885 | A | | 7/1976 |
| GB | 1442885 | | * | 7/1976 |
| GB | 1 517 029 | | | 7/1978 |
| GB | 2364324 | | | 1/2002 |
| GB | 2 372 500 | A | | 8/2002 |
| GB | 2372500 | | * | 8/2002 |
| WO | WO 96/36687 | | | 11/1996 |
| WO | WO 00/56851 | | | 9/2000 |
| WO | 02/068352 | | * | 9/2002 |
| WO | WO 2002/068352 | A2 | | 9/2002 |
| WO | WO 2005/005589 | A1 | | 1/2005 |
| WO | WO 2005/033724 | A1 | | 4/2005 |

OTHER PUBLICATIONS

"Emulsions," *Kirk-Othmer Encyclopedia of Chemical Technology—Diuretics to Emulsions*, Third Edition, vol. 8, pp. 900-912 (© 1979).

Jourbert, D. et al., "Etching of Glassware in Mechanical Dishwashing," *Soap & Chemical Specialties*, pp. 5, 62, 64, and 67-68 (mar. 1971).

"Table 4. Extraction Solvents and Reagents" and "Selected Sorbents," *Kirk-Othmer Encyclopedia of Chemical Technology*, Third Edition, vol. 23, pp. 319-320 (© 1979).

Altenschoepfer, T., "The Present Position of Investigations into the Behavior of Glass During Mechanical Washing," *The Effect of Detergents on Glassware . . . in Domestic Dishwashers, papers presented in symposium presided by W.W. Fletcher from the B.G.I.R.A—Sheffield held in the "Institut National du Verre" in Charleroi*, pp. 62-77 (Apr. 1971).

Mayaux, P., "Mechanism of Glass Attack by Chemical Agents," *The Effect of Detergents on Glassware . . . in Domestic Dishwashers, papers presented in symposium presided by W.W. Fletcher from the B.G.I.R.A—Sheffield held in the "Institut National du Verre" in Charleroi*, pp. 1-8 (Apr. 1971).

* cited by examiner

WAREWASHING COMPOSITION FOR USE IN AUTOMATIC DISHWASHING MACHINES, COMPRISING A MIXTURE OF ALUMINUM AND ZINC IONS

FIELD OF THE INVENTION

The invention relates to warewashing compositions for use in automatic dishwashing machines, methods for manufacturing warewashing compositions for use in automatic dishwashing machines, and methods for using warewashing compositions in automatic dishwashing machines. The automatic dishwashing machines can be commercial or domestic dishwashing machines. The warewashing composition includes a corrosion inhibitor to reduce corrosion and/or etching of glass.

BACKGROUND OF THE INVENTION

Glassware that is repetitively washed in automatic dishwashing machines has a tendency to develop a surface cloudiness that is irreversible. The cloudiness often manifests itself as an iridescent film that displays rainbow hues in light reflected from the glass surface. The glass becomes progressively more opaque with repeated washings. This cloudiness is believed to be a type of etching or corrosion of the glass. This same type of corrosion is seen on other articles including china, porcelain, and ceramics.

Corrosion of glass in automatic dishwashers is a well known o phenomenon. A paper by D. Joubert and H. Van Daele entitled "Etching of Glassware in Mechanical Dishwashing" in Soap and Chemical Specialties, March, 1971, pp. 62, 64, and 67, discusses the influence of various detergent components, particularly those of an alkaline nature. This subject is also discussed in a paper entitled "The Present Position of Investigations into the Behavior of Glass During Mechanical Dishwashing" presented by Th. Altenschoepfer in April, 1971, at a symposium in Charleroi, Belgium, on "The Effect of Detergents on Glassware in Domestic Dishwashers." See, also, another paper delivered at the same symposium by P. Mayaux entitled "Mechanism of Glass Attack by Chemical Agents."

It is believed that the glassware corrosion problem actually relates to two separate phenomena; the first is corrosion due to the leaching out of minerals from the glass composition itself together with hydrolysis of the silicate network, and the second is deposition and redeposition of silicate material onto the glass. It is a combination of the two that can result in the cloudy appearance of glassware that has been washed repeatedly in automatic dishwashers. This cloudiness often manifests itself in the early stages as an iridescent film that becomes progressively more opaque with repeated washings.

Corrosion inhibitors have been added to automatic dishwashing compositions to reduce the etching or corrosion found on glass. For example, see U.S. Pat. No. 2,447,297 to Wegst et al.; U.S. Pat. No. 2,514,304 to Bacon et al.; U.S. Pat. No. 4,443,270 to Baird et al.; U.S. Pat. No. 4,933,101 to Cilley et al.; U.S. Pat. No. 4,908,148 to Caravajal et al.; U.S. Pat. No., 4,390,441 to Beavan. Zinc has been disclosed for use in preventing glass corrosion. For example, see U.S. Pat. No. 4,917,812 to Cilley; U.S. Pat. No. 3,677,820 to Rutkowski; U.S. Pat. No. 3,255,117 to Knapp; U.S. Pat. No. 3,350,318 to Green; U.S. Pat. No. 2,575,576 to Bacon et al.; U.S. Pat. No. 3,755,180 to Austin; and U.S. Pat. No. 3,966,627 to Gray. Automatic dishwashing detergent compositions incorporating aluminum salts have been disclosed for reducing glass corrosion. See International Publication No. WO 96/36687; U.S. Pat. No. 3,701,736 to Austin et al.; U.S. Pat. No. 5,624,892 to Angevaare et al.; and U.S. Pat. No. 5,624,892 to Angevaare et al.; and U.S. Pat. No. 5,598,506 to Angevaare et al.

SUMMARY OF THE INVENTION

A warewashing detergent composition is provided according to the invention. The warewashing detergent composition includes a cleaning agent, an alkaline source, and a corrosion inhibitor. The cleaning agent comprises a detersive amount of a surfactant. The alkaline source is provided in an amount effective to provide a use solution having a pH of at least about 8. The corrosion inhibitor includes a source of aluminum ion and a source of zinc ion. The warewashing detergent composition can be provided in the form of a concentrate or in the form of a use solution.

A warewashing detergent composition can be provided according to the invention that includes a cleaning agent comprising a detersive amount of a surfactant, an alkaline source in an amount effective to provide the warewashing detergent composition with a pH of at least about 8, and between about 6 ppm and about 300 ppm of a corrosion inhibitor for reducing corrosion and/or etching of glass, wherein the corrosion inhibitor comprises an aluminum ion and a zinc ion at a weight ratio of the aluminum to the zinc ion of between about 6:1 and about 1:20.

A method for using a warewashing detergent composition is provided according to the invention. The method includes diluting the warewashing detergent composition with water at a ratio of water to the warewashing detergent composition of at least about 20:1 to provide a use solution, and washing articles with the use solution in an automatic dishwashing machine.

A method for manufacturing or formulating a warewashing detergent composition is provided according to the invention. The method includes a step of providing an amount of corrosion inhibitor in a warewashing detergent composition concentrate sufficient to provide a level of corrosion inhibitor in a use solution corresponding to the following formula:

$$\begin{matrix}\text{Corrosion inhibitor}\\ \text{use solution (ppm)}\end{matrix} > \frac{[\text{alkalinity (ppm)} + \text{builder (ppm)}]}{[\text{hardness (grains/gallon)} + \text{food soil (grams/gallon)}]} + \frac{[\text{alkalinity (ppm)} + \text{builder (ppm)} - 200]}{20} + 10$$

In the formula, the alkalinity refers to the alkalinity in ppm of a use solution, the builder refers to the amount of builder in ppm in the use solution, the hardness refers to the amount of hardness in grains per gallon in the use solution, and the food soil refers to the expected amount of food soil in grams per gallon in the use solution. The use solution can be provided as a result of diluting the warewashing detergent concentrate with water at a ratio of water to the warewashing detergent concentrate of at least about 20:1. The warewashing detergent composition additionally includes a cleaning agent and an alkaline source. The method can additionally include a step of solidifying the warewashing detergent concentrate to provide a solid.

DETAILED DESCRIPTION OF THE INVENTION

Figure 1:
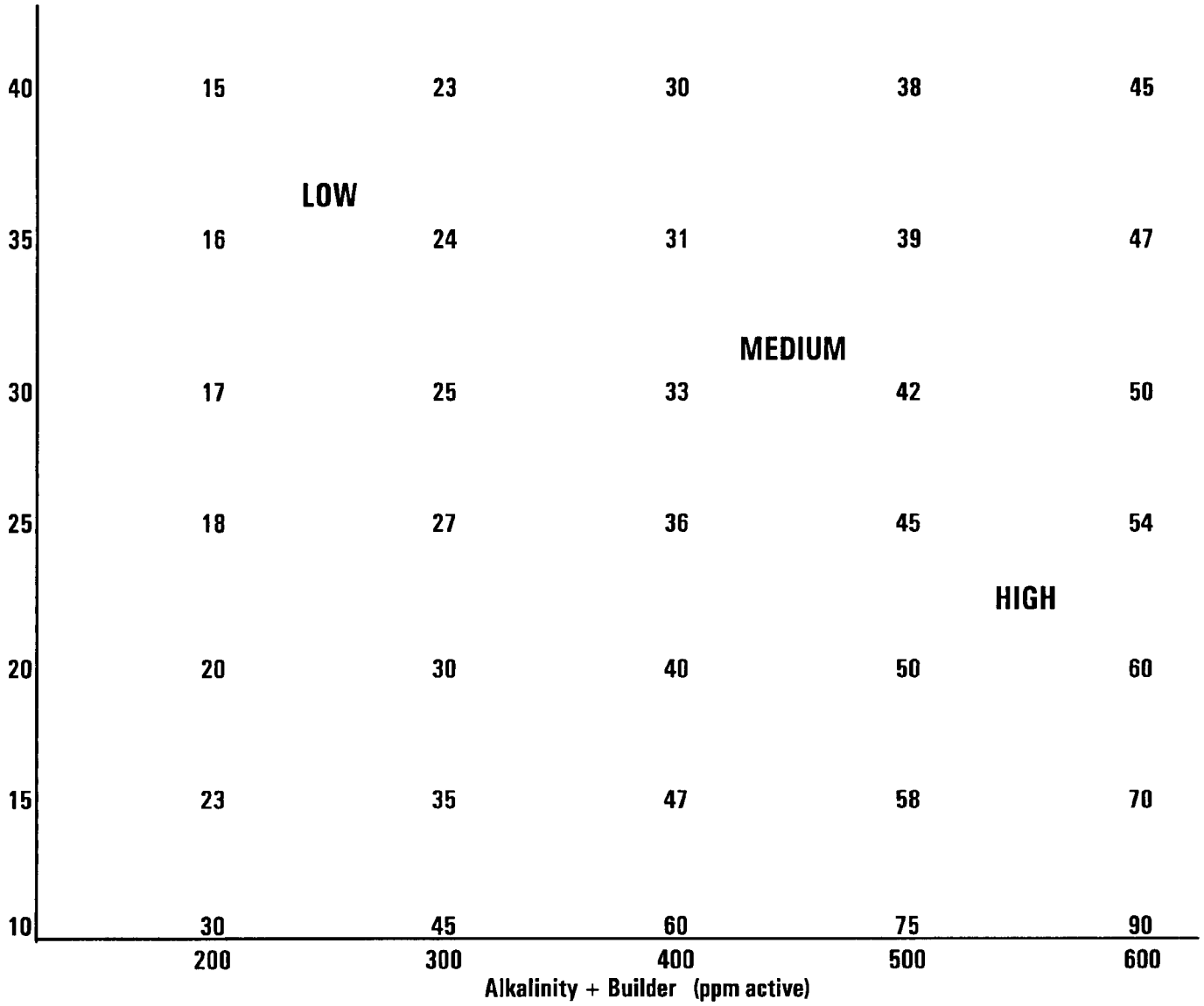
FIG. 1 is a graph displaying a guide for selecting corrosion inhibitor concentration in a use solution as a function of water hardness, food soil, alkalinity, and builder levels.

The invention provides a warewashing composition for protecting articles such as glassware from corrosion in an automatic dishwashing or warewashing machine during automatic dishwashing or warewashing. Glassware corrosion and/or etching can be detected as a cloudiness on the glass surface. The cloudiness can appear as an iridescent film that displays rainbow hues in light reflected from the glass surface. The warewashing composition can be referred to as a cleaning composition and can be available for cleaning in environments other than inside an automatic dishwashing or warewashing machine. It should be understood that the term "warewashing" refers to and is meant to include both warewashing and dishwashing.

The warewashing composition includes a corrosion inhibitor that includes an effective amount of a source of aluminum ion and an effective amount of a source of zinc ion to provide a use solution exhibiting resistance to glass corrosion and/or etching. The effective amount of a source of aluminum ion and the effective amount of a source of zinc ion can be characterized as amounts sufficient to provide a use solution exhibiting reduced glass corrosion and etching compared with a composition that is identical except that it contains only one of the source of aluminum ion and the source of zinc ion at a concentration equal to the combination of the source of aluminum ion and the source of zinc ion. It is expected that combining aluminum ion and zinc ion in a use solution will provide improved reduction of glass corrosion and/or etching compared with an otherwise identical use solution except containing only one of the aluminum ion and zinc ion at a concentration equivalent to the concentration of the combined amounts of aluminum ion and zinc ion. The combination of the source of aluminum ion and the source of zinc ion can be characterized as a synergistic combination when the improvement in corrosion and/or etching resistance is greater than the expected cumulative effect of the source of aluminum ion and the source of zinc ion.

The warewashing composition that contacts the articles to be washed in an automatic dishwashing process can be referred to as the use solution. The use solution can be provided at a solids concentration that provides a desired level of detersive properties. The solids concentration refers to the concentration of the non-water components in the use solution. The warewashing composition prior to dilution to provide the use solution can be referred to as the warewashing composition concentrate or more simply as the concentrate. The concentrate can be provided in various forms including as a liquid and as a solid. It is expected that the warewashing composition will be used by diluting the concentrate with water at the situs or location of use to provide the use solution. In most cases when using the warewashing composition in an automatic dishwashing or warewashing machine, it is expected that that situs or location of use will be inside the automatic dishwashing or warewashing machine.

The use solution should have a solids content that is sufficient to provide the desired level of cleaning while avoiding wasting the warewashing composition by using too much. In general, it is expected that the use solution will have a solids content of at least about 0.05 wt. %, and can have a solids content of between about 0.05 wt. % and about 0.75 wt. %. The use solution can be prepared from the concentrate by diluting with water at a dilution ratio that provides convenient use of the concentrate and provides the formation of a use solution having desired detersive properties. It is expected that the concentrate can be diluted at a ratio of water to concentrate of at least about 20:1, and can be at between about 20:1 and about 200:1, to provide a use solution having desired detersive properties.

The warewashing composition can be provided in the form of a solid. Exemplary solid dishwashing compositions are disclosed in U.S. Pat. Nos. 6,410,495 to Lentsch et al., 6,369,021 to Man et al., 6,258,765 to Wei et al, 6,177,392 to Lentsch et al., 6,164,296 to Lentsch et al., 6,156,715 to Lentsch et al., and 6,150,624 to Lentsch et al. The compositions of each of these patents are incorporated herein by reference. The compositions of each of these patents can be modified to provide a warewashing composition that includes an effective amount of a source of aluminum ion and an effective amount of a source of zinc ion to provide a warewashing use solution exhibiting reduced glass corrosion.

Corrosion Inhibitor

The corrosion inhibitor is included in the warewashing composition in an amount sufficient to provide a use solution that exhibits a rate of corrosion and/or etching of glass that is less than the rate of corrosion and/or etching of glass for an otherwise identical use solution except for the absence of the corrosion inhibitor. The corrosion inhibitor refers to the combination of a source of aluminum ion and a source of zinc ion. The source of aluminum ion and the source of zinc ion provide aluminum ion and zinc ion, respectively, when the warewashing composition is provided in the form of a use solution. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. It should be understood that aluminum ion can be considered a source of aluminum ion, and zinc ion can be considered a source of zinc ion. The source of aluminum ion and the source of zinc ion can be provided as organic salts, inorganic salts, and mixtures thereof. Exemplary sources of aluminum ion include aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate and aluminum phosphate. Exemplary sources of zinc ion include zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluosilicate, and zinc salicylate.

The applicants discovered that by controlling the ratio of the aluminum ion to the zinc ion in the use solution, it is possible to provide reduced corrosion and/or etching of glassware and ceramics compared with the use of either component alone. That is, the combination of the aluminum ion and the zinc ion can provide a synergy in the reduction of corrosion and/or etching. The ratio of the source of aluminum ion to the source of zinc ion can be controlled to provide a synergistic effect. In general, the weight ratio of aluminum ion to zinc ion in the use solution can be between at least about 6:1, can be less than about 1:20, and can be between about 2:1 and about 1:15.

The corrosion inhibitor can be provided in the use solution in an amount effective to reduce corrosion and/or etching of glass. It is expected that the use solution will include at least about 6 ppm of the corrosion inhibitor to provide desired corrosion inhibition properties. The amount of the corrosion inhibitor is calculated based upon the combined amount of the source of aluminum ion and the source of zinc ion. It is expected that larger amounts of corrosion inhibitor can be used in the use solution without deleterious effects. It is expected that at a certain point, the additive effect of increased corrosion and/or etching resistance with increasing corrosion inhibitor concentration will be lost, and additional corrosion inhibitor will simply increase the cost of using the cleaning composition. The use solution can include between about 6 ppm and about 300 ppm of the corrosion inhibitor, and between about 20 ppm and about 200 ppm of the corrosion inhibitor. In the case of the concentrate that is intended to be diluted to a use solution, it is expected that the corrosion inhibitor will be provided at a concentration of between about 0.5 wt. % and about 25 wt. %, and between about 1 wt. % and about 20 wt. %.

Alkaline Sources

The warewashing composition according to the invention may include an effective amount of one or more alkaline sources to enhance cleaning of a substrate and improve soil removal performance of the composition. In general, an effective amount of one or more alkaline sources should be considered as an amount that provides a use solution having a pH of at least about 8. When the use solution has a pH of between about 8 and about 10, it can be considered mildly alkaline, and when the pH is greater than about 12, the use solution can be considered caustic. In general, it is desirable to provide the use solution as a mildly alkaline cleaning composition because it is considered to be more safe than the caustic based use solutions.

The warewashing composition can include a metal carbonate and/or an alkali metal hydroxide. Exemplary metal carbonates that can be used include, for example, sodium or potassium carbonate, bicarbonate, sesquicarbonate, mixtures thereof. Exemplary alkali metal hydroxides that can be used include, for example, sodium or potassium hydroxide. An alkali metal hydroxide may be added to the composition in the form of solid beads, dissolved in an aqueous solution, or a combination thereof. Alkali metal hydroxides are commercially available as a solid in the form of prilled solids or beads having a mix of particle sizes ranging from about 12–100 U.S. mesh, or as an aqueous solution, as for example, as a 50 wt. % and a 73 wt. % solution.

The warewashing composition can include a sufficient amount of the alkaline source to provide the use solution with a pH of at least about 8. In general, it is expected that the concentrate will include the alkaline source in an amount of at least about 5 wt. %, at least about 10 wt. %, or at least about 15 wt. %. In order to provide sufficient room for other components in the concentrate, the alkaline source can be provided in the concentrate in an amount of less than about 60 wt. %.

Cleaning Agent

The warewashing composition can include at least one cleaning agent comprising a surfactant or surfactant system. A variety of surfactants can be used in a warewashing composition, such as anionic, nonionic, cationic, and zwitterionic surfactants. It should be understood that surfactants are an optional component of the warewashing composition and can be excluded from the concentrate. The warewashing composition, when provided as a concentrate, can include between about 0.5 wt. % and about 20 wt. % of the cleaning agent and between about 1.5 wt. % and about 15 wt. % of the cleaning agent. Additional exemplary ranges of surfactant in a concentrate include about 0.5 wt. % to about 5 wt. %, and about 1 wt. % to about 3 wt. %.

Exemplary surfactants that can be used are commercially available from a number of sources. For a discussion of surfactants, see Kirk-Othmer, Encyclopedia of Chemical Technology, Third Edition, volume 8, pages 900–912. When the warewashing composition includes a cleaning agent, the cleaning agent can be provided in an amount effective to provide a desired level of cleaning.

Anionic surfactants useful in the warewashing composition includes, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Exemplary anionic surfactants include sodium alkylarylsulfonate, alpha-olefinsulfonate, and fatty alcohol sulfates.

Nonionic surfactants useful in the warewashing composition include, for example, those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC® (BASF-Wyandotte), and the like; and other like nonionic compounds. Silicone surfactants such as the ABIL® B8852 can also be used.

Cationic surfactants that can be used in the warewashing composition include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$–$C_{18}$) dimethylbenzyl ammonium chloride, n-tetradecyldimethylbenzylammonium chloride monohydrate, a naphthylene-substituted quaternary ammonium chloride such as dimethyl-1-naphthylmethylammonium chloride, and the like. The cationic surfactant can be used to provide sanitizing properties.

Zwitterionic surfactants that can be used in the warewashing composition include betaines, imidazolines, and propinates. Because the warewashing composition is intended to be used in an automatic dishwashing or warewashing machine, the surfactants selected, if any surfactant is used, can be those that provide an acceptable level of foaming when used inside a dishwashing or warewashing machine. It should be understood that warewashing compositions for use in automatic dishwashing or warewashing machines are generally considered to be low-foaming compositions.

Other Additives

The warewashing composition can include other additives, including conventional additives such as chelating/sequestering agents, bleaching agents, detergent builders or fillers, hardening agents or solubility modifiers, defoamers, anti-redeposition agents, threshold agents, aesthetic enhancing agents (i.e., dye, perfume), and the like. Adjuvants and other additive ingredients will vary according to the type of composition being manufactured. It should be understood that these additives are optional and need not be included in the cleaning composition. When they are included, they can be included in an amount that provides for the effectiveness of the particular type of component.

The warewashing composition can include chelating/sequestering agents such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. In general, chelating/sequestering agents can generally be referred to as a type of builder. The chelating/sequestering agent may also function as a threshold agent when included in an effective amount. The concentrate can include about 0.1 wt. % to about 70 wt. %, about 5 wt. % to about 60 wt. %, about 5 wt. % to about 50 wt. %, and about 10 wt. % to about 40 wt. % of a chelating/sequestering agent.

Exemplary aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$(HEDP);

amino tri(methylenephosphonic acid) $N[CH_2PO(OH)_2]_3$;

aminotri(methylenephosphonate), sodium salt

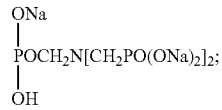

2-hydroxyethyliminobis(methylenephosphonic acid) $HOCH_2CH_2N[CH_2PO(OH)_2]_2$;

diethylenetriaminepenta(methylenephosphonic acid) $(HO)_2POCH_2N[CH_2CH_2N[CH_2PO(OH)_2]_2]_2$;

diethylenetriaminepenta(methylenephosphonate), sodium salt $C_9H_{(28-x)}N_3Na_xO_{15}P_5$ (x=7); hexamethylenediamine (tetramethylenephosphonate), potassium salt $C_{10}H_{(28-x)}N_2K_xO_{12}P_4$ (x=6); bis(hexamethylene)triamine(pentamethylenephosphonic acid) $(HO_2)POCH_2N[(CH_2)_6N[CH_2PO(OH)_2]_2]_2$; and phosphorus acid $H_3PO_3$.

Exemplary phosphonates are HEDP, ATMP and DTPMP. A neutralized or alkaline phosphonate, or a combination of the phosphonate with an alkali source prior to being added into the mixture such that there is little or no heat or gas generated by a neutralization reaction when the phosphonate is added is preferred. The phosphonate can comprise a potassium salt of an organo phosphonic acid (a potassium phosphonate). The potassium salt of the phosphonic acid material can be formed by neutralizing the phosphonic acid with an aqueous potassium hydroxide solution during the manufacture of the solid detergent. The phosphonic acid sequestering agent can be combined with a potassium hydroxide solution at appropriate proportions to provide a stoichiometric amount of potassium hydroxide to neutralize the phosphonic acid. A potassium hydroxide having a concentration of from about 1 to about 50 wt % can be used. The phosphonic acid can be dissolved or suspended in an aqueous medium and the potassium hydroxide can then be added to the phosphonic acid for neutralization purposes.

Water conditioning polymers can be used as a form of builder. Exemplary water conditioning polymers include polycarboxylates. Exemplary polycarboxylates that can be used as builders and/or water conditioning polymers include those having pendant carboxylate ($—CO_2^-$) groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, Encyclopedia of Chemical Technology, Third Edition, volume 5, pages 339–366 and volume 23, pages 319–320, the disclosure of which is incorporated by reference herein. The concentrate can include the water conditioning polymer in an amount of between about 0.1 wt. % and about 5 wt. %, and between about 0.2 wt. % and about 2 wt. %.

Bleaching agents for use in a cleaning compositions for lightening or whitening a substrate, include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the present cleaning compositions include, for example, chlorine-containing compounds such as a chlorine, a hypochlorite, chloramine. Exemplary halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The composition can include an effective amount of a bleaching agent. When the concentrate includes a bleaching agent, it can be included in an amount of about 0.1 wt. % to about 10 wt. %, about 1 wt. % to about 10 wt. %, about 3 wt. % to about 8 wt. %, and about 3 wt. % to about 6 wt. %.

The composition can include an effective amount of detergent fillers, which does not perform as a cleaning agent per se, but cooperates with the cleaning agent to enhance the overall cleaning capacity of the composition. Examples of detergent fillers suitable for use in the present cleaning compositions include sodium sulfate, sodium chloride, starch, sugars, $C_1$–$C_{10}$ alkylene glycols such as propylene glycol, and the like. When the concentrate includes a detergent filler, it can be included an amount of about 1 wt. % to about 20 wt. % and between about 3 wt. % to about 15 wt. %.

A defoaming agent for reducing the stability of foam may also be included in the composition to reduce foaming. When the concentrate includes a defoaming agent, the defoaming agent can be provided in an amount of between about 0.01 wt. % and about 3 wt. %.

Examples of defoaming agents that can be used in the composition includes ethylene oxide/propylene block copolymers such as those available under the name Pluranic N-3, silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

The composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. When the concentrate includes an anti-redeposition agent, the anti-redeposition agent can be included in an amount of between about 0.5 wt. % to about 10 wt. %, and between about 1 wt. % and about 5 wt. %.

Various dyes, odorants including perfumes, and other aesthetic enhancing agents can be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

The components used to form the concentrate can include an aqueous medium such as water as an aid in processing. It is expected that the aqueous medium will help provide the components with a desired viscosity for processing. In addition, it is expected that the aqueous medium may help in the solidification process when is desired to form the concentrate as a solid. When the concentrate is provided as a solid, it can be provided in the form of a block or pellet. It is expected that blocks will have a size of at least about 5 grams, and can include a size of greater than about 50 grams. It is expected that the concentrate will include water in an amount of between about 1 wt. % and about 50 wt. %, and between about 2 wt. % and about 40 wt. %.

When the components that are processed to form the concentrate are processed into a block, it is expected that the components can be processed by extrusion techniques or casting techniques. In general, when the components are processed by extrusion techniques, it is believed that the composition can include a relatively smaller amount of water as an aid for processing compared with the casting techniques. In general, when preparing the solid by extrusion, it is expected that the composition can contain between about 2 wt. % and about 10 wt. % water. When preparing the solid by casting, it is expected that the amount of water can be provided in an amount of between about 20 wt. % and about 40 wt. %.

Formulating the Warewashing Composition

The warewashing detergent composition can be formulated to handle the expected corrosion and/or etching in a given environment. That is, the concentration of the corrosion inhibitors can be adjusted depending upon several factors at the situs of use including, for example, water hardness, food soil concentration, alkalinity, and builder concentration. It is expected that the concentration of each of these can have an effect on glass corrosion and/or etching. In machine warewashing applications, a food soil concentration of about 25 grams per gallon or more is considered high, a concentration of about 15 to about 24 grams per gallon is considered medium, and a concentration of about 14 grams per gallon or less is considered low. Water hardness exhibiting 15 grains per gallon or more is considered high, about 6 to about 14 grains per gallon is considered medium, and about 5 grains per gallon or less is considered low. In a use solution, an alkalinity of about 300 ppm or higher is considered high, an alkalinity of about 200 ppm to about 300 ppm is considered medium, and an alkalinity of about 200 ppm or less is considered low. In a use solution, a builder concentration of about 300 ppm or more is considered high, a builder concentration of about 150 ppm to about 300 ppm is considered medium, and a builder concentration of 150 ppm or less is considered low.

Based upon the expected conditions of use, the warewashing detergent composition can be formulated to provide the desired level of corrosion and/or etching resistance. Based upon the knowledge of water hardness, food soil concentration, alkalinity, and builder concentration expected at the situs of use, the detergent composition can be formulated with a sufficient amount of corrosion inhibitor by reference to FIG. 1. In FIG. 1, the charted values represent the concentration of corrosion inhibitor provided in the use solution.

When formulating or manufacturing the detergent composition, the amount of corrosion inhibitor can be provided based upon the expected levels of water hardness, food soil concentration, alkalinity, and builder concentration at the situs of use. The amount of corrosion inhibitor in the use solution to provide the desired level of corrosion and/or etching resistance can be provided based upon the following formula:

$$\text{Corrosion inhibitor use solution (ppm)} > \frac{[\text{alkalinity (ppm)} + \text{builder (ppm)}]}{[\text{hardness (grains/gallon)} + \text{food soil (grams/gallon)}]} + \frac{[\text{alkalinity (ppm)} + \text{builder (ppm)} - 200]}{20} + 10$$

Based on the desired minimum concentration of the corrosion inhibitor in the use solution, the amount of the corrosion inhibitor in the concentrate can be calculated knowing the solids content of the use solution and the concentrate can be formulated to provide at least the desired level of corrosion protection.

Forming the Solid Concentrate

The components can be mixed and extruded or cast to form a solid such as pellets or blocks. Heat can be applied from an external source to facilitate processing of the mixture.

A mixing system provides for continuous mixing of the ingredients at high shear to form a substantially homogeneous liquid or semi-solid mixture in which the ingredients are distributed throughout its mass. The mixing system includes means for mixing the ingredients to provide shear effective for maintaining the mixture at a flowable consistency, with a viscosity during processing of about 1,000–1,000,000 cP, preferably about 50,000–200,000 cP. The mixing system can be a continuous flow mixer or a single or twin screw extruder apparatus.

The mixture can be processed at a temperature to maintain the physical and chemical stability of the ingredients, such as at ambient temperatures of about 20–80° C., and about 25–55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the cleaning agent, the aqueous medium, and additional ingredients such as a second cleaning agent, a detergent adjuvant or other additive, a secondary hardening agent, and the like. One or more premixes may be added to the mixture.

The ingredients are mixed to form a substantially homogeneous consistency wherein the ingredients are distributed substantially evenly throughout the mass. The mixture can be discharged from the mixing system through a die or other shaping means. The profiled extrudate can be divided into useful sizes with a controlled mass. The extruded solid can be packaged in film. The temperature of the mixture when discharged from the mixing system can be sufficiently low to enable the mixture to be cast or extruded directly into a packaging system without first cooling the mixture. The time between extrusion discharge and packaging can be adjusted to allow the hardening of the detergent block for better handling during further processing and packaging. The mixture at the point of discharge can be about 20–90° C., and about 25–55° C. The composition can be allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained preferably at about 20–90° C.

When processing of the ingredients is completed, the mixture may be discharged from the mixer through a discharge die. The composition eventually hardens due to the chemical reaction of the ingredients forming the E-form hydrate binder. The solidification process may last from a few minutes to about six hours, depending, for example, on the size of the cast or extruded composition, the ingredients of the composition, the temperature of the composition, and other like factors. Preferably, the cast or extruded composition "sets up" or begins to hardens to a solid form within about 1 minute to about 3 hours, preferably about 1 minute to about 2 hours, preferably about 1 minute to about 20 minutes.

The packaging receptacle or container may be rigid or flexible, and composed of any material suitable for containing the compositions produced according to the invention, as for example glass, metal, plastic film or sheet, cardboard, cardboard composites, paper, and the like. Advantageously, since the composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. Preferred packaging used to contain the compositions is manufactured from a flexible, easy opening film material.

The cleaning composition made according to the present invention is dispensed from a spray-type dispenser such as that disclosed in U.S. Pat. Nos. 4,826,661, 4,690,305, 4,687,121, 4,426,362 and in U.S. Pat. Nos. Re 32,763 and 32,818, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use. When used, the product can be removed from the package (e.g.) film and is inserted into the dispenser. The spray of water can be made by a nozzle in a shape that conforms to the solid detergent shape. The dispenser enclosure can also closely fit the detergent shape in a dispensing system that prevents the introduction and dispensing of an incorrect detergent.

While the invention is described in the context of a warewashing composition for washing articles in an automatic dishwashing machine, it should be understood that the warewashing composition can be used for washing non-ware items. That is, the warewashing composition can be referred to as a cleaning composition and can be used to clean various items and, in particular, items that may suffer from corrosion and/or etching. Because the warewashing composition can be used in an automatic dishwashing machine, there are certain components that can be excluded from the warewashing composition because their presence would be detrimental in an automatic dishwashing machine.

The above specification provides a basis for understanding the broad meets and bounds of the invention. The following examples and test data provide an understanding of certain specific embodiments of the invention. The examples are not meant to limit the scope of the invention that has been set forth in the foregoing description. Variations within the concepts of the invention are apparent to those skilled in the art.

EXAMPLES

The following examples were conducted to compare the etching of glassware from Libbey glass based on several warewashing compositions. The glassware obtained was unused and fresh out of the box. One glass was used per test. The containers used to hold the sample were quartz plastic containers without paper liners in the lid.

The following procedure was followed.

1. Place gloves on before washing the glasses to prevent skin oils from contacting the glassware.
2. The glassware is scrubbed thoroughly with neutral pH liquid dish detergent (a pot and pan detergent available under the name "Express" from Ecolab Inc.) to remove dirt and oil and allowed to air dry.
3. Rinse all plastic containers with distilled water to remove any dust and allow to air dry.
4. Detergent solutions are prepared.
5. Place one glass in each plastic container and pour a solution into the plastic container ensuring that the glass is completely covered. Put the lid on the container and label with the solution name.
6. 20 mL of each solution is poured into 1 oz. plastic bottles and labeled.
7. Place the plastic containers in an agitated water bath. Control the temperature of the water bath to 160° F.
8. A water dispensing mechanism is set up to replenish the water bath throughout the duration of the test.
9. Collect 20 mL samples of the solution every 48 hours and place in the 1 oz. plastic bottles.
10. Upon completion of the test, samples were analyzed for calcium and silicon content.

To measure glass corrosion and demonstrate the protective effect of the corrosion inhibitor, the rates at which components were removed from the glassware exposed to the detergent solutions are measured. Over a period of days, the change in concentration of elemental silicon and elemental calcium in the detergent solution samples was analytically measured. Common soda-lime glass includes oxides of silicon, sodium, calcium, magnesium, and aluminum. Since it is well known that detergent builders can form complexes with calcium, the presence of calcium in the test solutions was measured to determine whether the detergent builders were accelerating the removal of calcium from the glass surface, thereby contributing to the corrosion process. The glass specimens were submerged in the detergents solutions at elevated temperatures. Polyethylene bottles were used to contain the solutions, so the only source of the elements of interest was the glass specimens.

Example 1

Table 1 reports the inhibition effect of sodium aluminate and zinc chloride in a sodium carbonate-based detergent solution. The composition of Base Composition 1 is reported in Table 2.

TABLE 1

Effect of Zinc and Aluminum Inhibitors, Sodium Carbonate-Based Detergent Composition

| Detergent Solution | | | | | | | | | Silicon Concentration Exposure Time (Hrs) | |
|---|---|---|---|---|---|---|---|---|---|---|
| Product | Product Conc. | NaOH (ppm) | Ash (ppm) | Builder (ppm) | Zn (ppm) | Al (ppm) | Water | Temp. ° F. | 24 | 48 |
| Base Composition 1 | | 2.26 | 46.78 | 32.9 | 24 | | distilled | 160 | 2.14 | 3.91 |
| Base Composition 1 | | 2.26 | 46.78 | 32.9 | | 16.5 | distilled | 161 | 2.88 | 5.12 |
| Base Composition 1 | | 2.26 | 46.78 | 32.9 | 12 | 8.3 | distilled | 162 | 0.84 | 1.08 |
| Base Composition 1 | | 2.26 | 46.78 | 32.9 | 24 | 16.5 | distilled | 163 | <0.05 | 0.67 |

TABLE 2

Base Composition 1

| Component | % by wt. |
|---|---|
| Soft Water | 6.5 |
| alcohol ethoxylate | 2.5 |
| EO, PO block polymer | 1.4 |
| phosphate ester | 0.2 |

TABLE 2-continued

Base Composition 1

| Component | % by wt. |
|---|---|
| Sodium aminotriemethylenephosphonate | 5.9 |
| Sodium Carbonate | 51 |
| Sodium tripolyphosphate | 30 |
| Sodium Hydroxide | 2 |
| Nonionic surfactant | 0.5 |

Without the corrosion inhibitor present, the concentration of silica and calcium in solution increases over time as the materials are removed from the glass surface. With the corrosion inhibitor present, the concentration of silica and calcium still increases, but at a dramatically lower rate.

The testing showed that the presences of both sodium aluminate and zinc chloride in the detergent solution reduced the rate of silica and calcium removed from the glass. The combination of sodium aluminate and zinc chloride reduced the corrosion rate more than an equal concentration of either one alone.

Example 2

The corrosion inhibition effect of sodium aluminate and zinc chloride in a caustic detergent solution is reported in Table 3. The composition of Base Composition 2 used to form the detergent solution is reported in Table 4.

TABLE 3

Protective Effect of Glass Corrosion Inhibitors in a Caustic Detergent Composition

| Product | | | | | test | Silicon concentration (ppm) Exposure Time (hrs) | | | | | Calcium concentration (ppm) Exposure Time (hrs) | | | | |
|---|---|---|---|---|---|---|---|---|---|---|---|---|---|---|---|
| Product | Conc. (ppm) | Zn (ppm) | Al (ppm) | Water | TEMP ° F. | 24 Hrs. | 48 Hrs. | 72 Hrs. | 96 Hrs. | 120 Hrs. | 24 Hrs. | 48 Hrs. | 72 Hrs. | 96 Hrs. | 120 Hrs. |
| Base Composition 2 | 1200 | 0 | 0 | distilled | 160 | 44 | 71 | 83 | 103 | 145 | 9 | 12 | 15 | | 27 |
| Base Composition 2 | 1200 | 12 | 8 | distilled | 160 | 2 | 4 | 7 | 10 | | 1 | 1 | 2 | 2 | |

TABLE 4

Base Composition 2

| Component | % by wt. |
|---|---|
| Water | 17.000 |
| Nonionic surfactant | 1.000 |
| Polycarboxylic acid | 2.000 |
| Sodium hydroxide | 34.000 |
| Sodium Carbonate | 17.000 |
| Dye | 0.003 |
| Sodium tripolyphosphate | 29.00 |

Example 3

The effect of water hardness and caustic-based detergent composition on glass corrosion is reported in Table 5. The water hardness is reported in units of gpg (grains per gallon) wherein one grain is equivalent to 17.1 ppm of water hardness as expressed in calcium carbonate. The composition of Base Composition 3 is reported in Table 6.

TABLE 5

Effect of Water Hardness and Caustic-based Detergent Composition

| | Product | | | Water | test | Silicon concentration (ppm) Exposure Time (hrs) | | | | |
|---|---|---|---|---|---|---|---|---|---|---|
| | conc. (ppm) | Zn (ppm) | Al (ppm) | Hardness (gpg) | TEMP. ° F. | 24 Hrs. | 48 Hrs. | 72 Hrs. | 96 Hrs. | 120 Hrs. |
| Base Composition 3 | 1200 | 0 | 0 | 17 | 160 | 12 | 34 | 47 | 81 | |
| Base Composition 3 | 1200 | 0 | 0 | 0 | 160 | 44 | 71 | 83 | 103 | 145 |

TABLE 6

Base Composition 3

| Component | % by wt. |
|---|---|
| Sodium carbonate | 41.100 |
| Sodium sulfate | 14.385 |
| Nonionic surfactant | 0.215 |
| Alcohol ethoxylate surfactant | 2.500 |
| Sodium polyacrylate | 0.300 |
| Sodium silicate $2.00SiO_2/Na_2O$ | 6.000 |

TABLE 6-continued

Base Composition 3

| Component | % by wt. |
|---|---|
| Sodium tripoly phosphate | 30.500 |
| Sodium perborate monohydrate | 5.000 |

Example 4

The effect of food soil and caustic-based detergent composition on glass corrosion is reported in Table 7. The food soil provided was beef stew soil at 2 wt. % in the test solution. The composition of Base Composition 4 is reported in Table 8.

TABLE 7

Effect of Food Soil, Caustic-based Detergent

| | Product | | | | Water | test | Silicon concentration (ppm) Exposure Time (hrs) | | Calcium concentration (ppm) Exposure Time (hrs) | |
|---|---|---|---|---|---|---|---|---|---|---|
| | conc. (ppm) | Inhibitor (ppm) | Zn (ppm) | Al (ppm) | Hardness (gpg) | TEMP. ° F. | 48 Hrs. | 96 Hrs. | 48 Hrs. | 96 Hrs. |
| Base Composition 4 with food soil | 1200 | 0 | 0 | 0 | city | 160 | 23 | 47 | 7 | 8 |
| Base Composition 4 without food soil | 1200 | 0 | 0 | 0 | city | 160 | 40 | 94 | 9 | 19 |

TABLE 8

| Base Composition 4 | |
|---|---|
| Component | % by wt. |
| Water | 24.000 |
| Nonionic surfactant | 1.000 |
| Polycarboxylic acid | 2.000 |
| Sodium hydroxide | 43.000 |

TABLE 8-continued

| Base Composition 4 | |
|---|---|
| Component | % by wt. |
| Sodium Chloride | 10.000 |
| Sodium Nitrilotriacetate | 20.00 |

Example 5

The corrosion inhibition effect of corrosion inhibitors in sodium carbonate-based detergent composition is reported in Table 9.

TABLE 9

Effect of Glass Corrosion Inhibitors, Sodium Carbonate-based Detergent Composition

| | Product | | | | test | Silicon concentration (ppm) Exposure Time (hrs) | | | | | Calcium concentration (ppm) Exposure Time (hrs) | | | | |
|---|---|---|---|---|---|---|---|---|---|---|---|---|---|---|---|
| Product | Conc. (ppm) | Zn (ppm) | Al (ppm) | Water | TEMP ° F. | 24 Hrs. | 48 Hrs. | 72 Hrs. | 96 Hrs. | 120 Hrs. | 24 Hrs. | 48 Hrs. | 72 Hrs. | 96 Hrs. | 120 Hrs. |
| Base Composition 3 | 1200 | | | distilled | 160 | 27 | 39 | 51 | | 71 | 6 | 8 | 10 | | 13 |
| Base Composition 3 | 1200 | 12 | 8 | distilled | 160 | 0 | 2 | 3 | 2 | | 0 | 0 | 1 | 1 | |

Example 6

The effect of food soil and sodium carbonate-based detergent composition on glass corrosion is reported in Table 10. The food soil is an oatmeal soil at 2 wt. % in the test solution.

TABLE 10

Effect of Food Soil, Sodium Carbonate-based Detergent Composition

| | Product | | | | test | Silicon concentration (ppm) Exposure Time (hrs) | | Calcium concentration (ppm) Exposure Time (hrs) | |
|---|---|---|---|---|---|---|---|---|---|
| | conc. (ppm) | Zn (ppm) | Al (ppm) | Water type | TEMP. ° F. | 48 Hrs. | 96 Hrs. | 48 Hrs. | 96 Hrs. |
| Base Composition 3 without food soil | 1200 | 1 | 1 | soft | 160 | 7 | 16 | 4 | 6 |
| Base Composition 3 with food soil | 1200 | 1 | 1 | soft | 160 | 4 | 10 | 0 | 0 |

Example 7

The effect of water hardness and sodium carbonate-based detergent composition is reported in Table 11.

TABLE 11

Effect of Water Hardness, Sodium Carbonate-based Detergent Composition

| | Product | | | | test | Silicon concentration (ppm) Exposure Time (hrs) | | Calcium concentration (ppm) Exposure Time (hrs) | |
|---|---|---|---|---|---|---|---|---|---|
| | conc. (ppm) | Zn (ppm) | Al (ppm) | Water type | TEMP. ° F. | 48 Hrs. | 96 Hrs. | 48 Hrs. | 96 Hrs. |
| Base Composition 3 | 4300 | 41 | 28 | soft | 160 | 8 | 13 | 3 | 5 |
| Base Composition 3 | 4300 | 41 | 28 | hard | 160 | 0 | 0 | 0 | 0 |
| Base Composition 3 | 4300 | 41 | 28 | city | 160 | 2 | 3 | 1 | 3 |

Example 8

The corrosion inhibiting effect of corrosion inhibitors and non-phosphate, NTA-based detergent composition is reported in Table 12.

TABLE 12

Effect of Glass Corrosion Inhibitors, Non-Phosphate, NTA-Based Detergent Composition

| | Product conc. (ppm) | Zn (ppm) | Al (ppm) | Water type | test TEMP. ° F. | Silicon concentration (ppm) Exposure Time (hrs) 96 Hrs. | Calcium concentration (ppm) Exposure Time (hrs) 96 Hrs. |
|---|---|---|---|---|---|---|---|
| Base Composition 4 | 1200 | | | distilled | 160 | 92 | 17 |
| Base Composition 4 | 1200 | 12 | 8 | distilled | 160 | 22 | 4 |

Example 9

Figure 2:
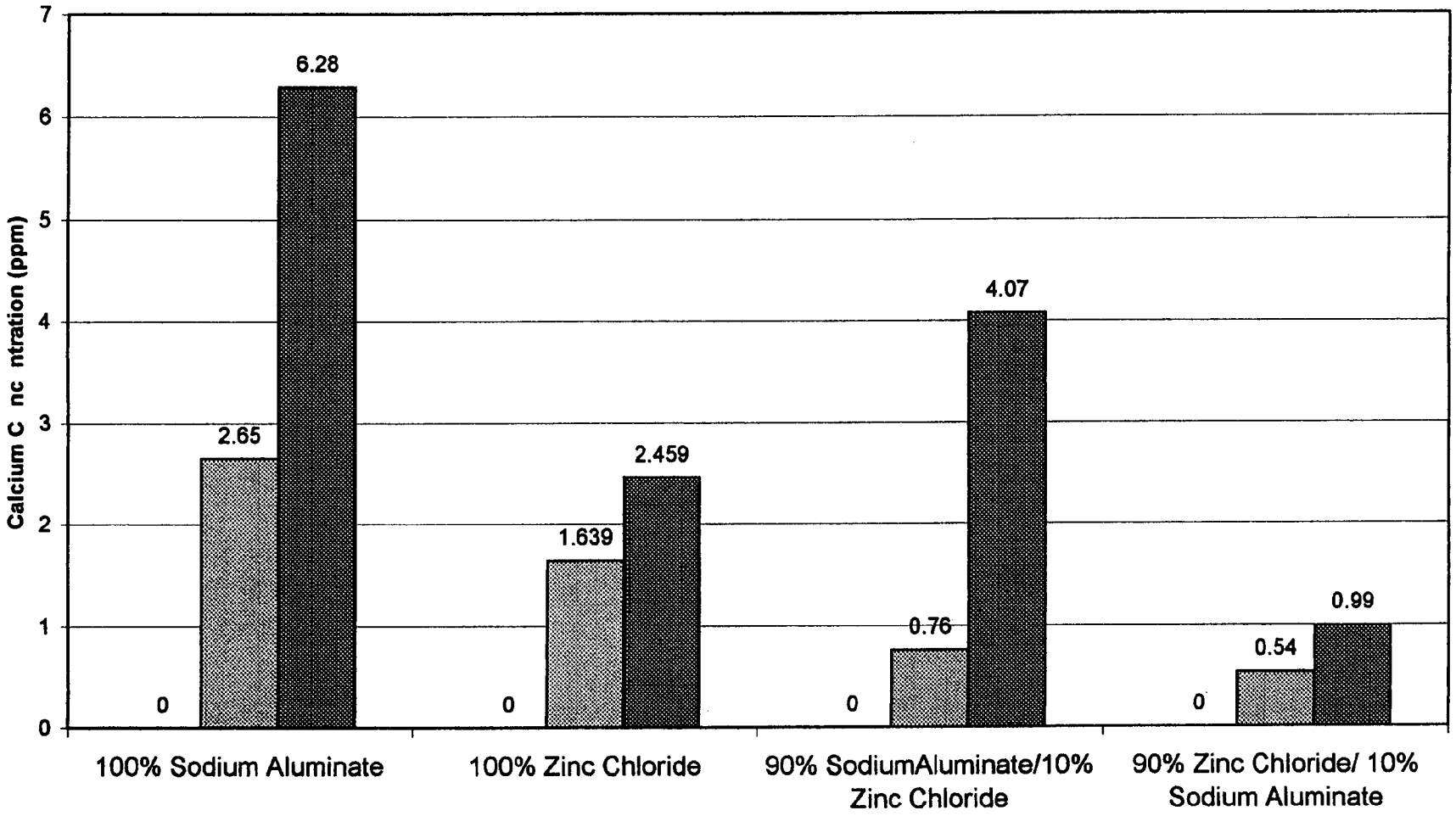
FIG. 2 is a graph showing silicon concentration in four warewashing compositions at 48 hours and 96 hours according to Example 9.
Figure 3:
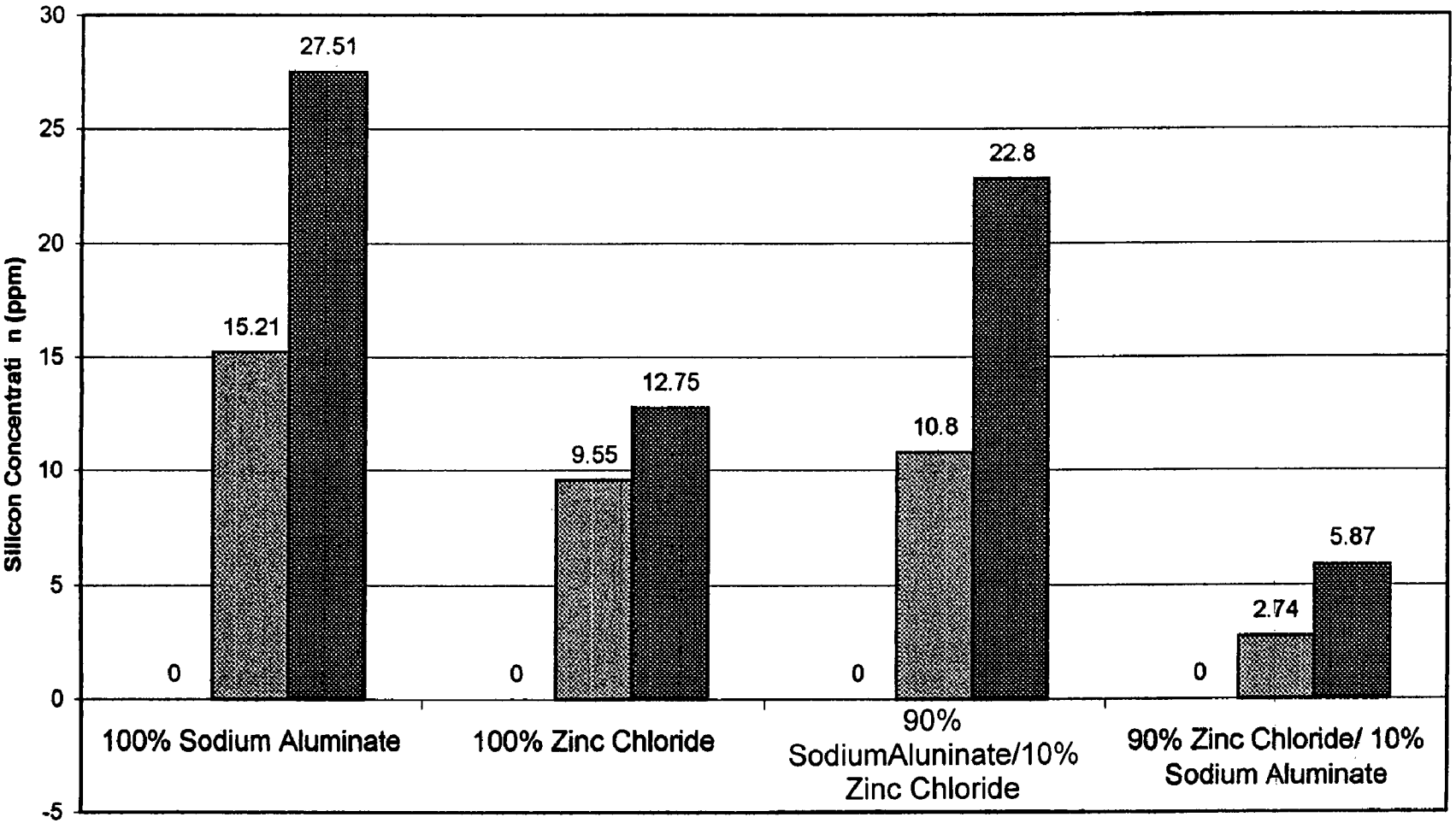
FIG. 3 is a graph showing calcium concentration in four warewashing compositions at 48 hours and 96 hours according to Example 9.

The effect of the amount of corrosion inhibitor in the concentrate is reported in Table 13. The data from Table 13 is graphically represented in FIGS. 2 and 3.

TABLE 13

Effect of Corrosion Inhibitor

| | Product | | | | test | Silicon concentration (ppm) Exposure Time (hrs) | | Calcium concentration (ppm) Exposure Time (hrs) | |
|---|---|---|---|---|---|---|---|---|---|
| | conc. (ppm) | Zn (ppm) | Al (ppm) | Water type | TEMP. ° F. | 48 Hrs. | 96 Hrs. | 48 Hrs. | 96 Hrs. |
| Base Composition 1 | 1200 | 23 | | soft | 160 | 10 | 13 | 1.6 | 2.5 |
| Base Composition 1 | 1200 | | 16 | soft | 160 | 15 | 28 | 3 | 6 |
| Base Composition 1 | 1200 | 2.3 | 14.00 | soft | 160 | 11 | 26 | 1 | 4 |
| Base Composition 1 | 1200 | 21.00 | 1.60 | soft | 160 | 3 | 6 | 0.5 | 1 |

We claim:

1. A warewashing detergent composition comprising:

(a) a cleaning agent comprising about 0.5 wt. % to about 20 wt. % surfactant based on the weight of the detersive composition;

(b) an alkaline source in an amount effective to provide a use solution having a pH of at least about 8 and wherein said use solution is obtained by diluting the warewashing detergent composition with water;

(c) a corrosion inhibitor in an amount sufficient for reducing corrosion and/or reducing the etching of glass, the corrosion inhibitor comprising:

(i) a source of aluminum ion;

(ii) a source of zinc ion, wherein the amount of the source of aluminum ion and the source of zinc ion is sufficient to provide a weight ratio of aluminum ion to zinc ion of about 6:1 to about 1:20; and (d) encapsulated chlorine bleaching agent.

2. A warewashing detergent composition according to claim 1, wherein the amount of source of aluminum ion and the amount of source of zinc ion is sufficient to provide a weight ratio of aluminum ion to zinc ion of about 2:1 to about 1:15.

3. A warewashing detergent composition according to claim 1, wherein the warewashing detergent composition further comprises about 0.1 wt. % to about 70 wt. % chelating/sequestering agent.

4. A warewashing detergent composition according to claim 1, wherein the warewashing detergent composition comprises about 0.1 wt. % to about 10 wt. % of the bleaching agent.

5. A warewashing detergent composition according to claim 1, wherein the warewashing detergent composition further comprises about 1 wt. % to about 20 wt. % detergent filler.

6. A warewashing detergent composition according to claim 1, wherein the warewashing detergent composition further comprises about 0.5 wt. % to about 10 wt. % anti-redeposition agent.

7. A warewashing detergent composition according to claim 1, wherein the warewashing detergent composition further comprises about 2 wt. % to about 10 wt. % water.

8. A warewashing detergent composition according to claim 1, wherein the warewashing detergent composition further comprises about 20 wt. % to about 40 wt. % water.

9. A warewashing detergent composition according to claim 1, wherein the warewashing detergent composition is in the form of a block having a size of at least about 5 grams.

10. A warewashing detergent composition according to claim 1, wherein the warewashing detergent composition is in the form of a block having a size of at least about 50 grams.

11. A warewashing detergent composition according to claim 1, wherein the composition is provided in the form of a pellet.

* * * * *